United States Patent [19]

Martin

[11] 4,328,793

[45] * May 11, 1982

[54] MULTI-MODAL LOW NOISE INCUBATOR

[76] Inventor: Paul F. Martin, 86 Townsend Rd., Wellington, New Zealand

[ * ] Notice: The portion of the term of this patent subsequent to Mar. 4, 1997, has been disclaimed.

[21] Appl. No.: 29,136

[22] Filed: Apr. 11, 1979

Related U.S. Application Data

[63] Continuation-in-part of Ser. No. 857,913, Dec. 6, 1977, abandoned.

[30] Foreign Application Priority Data

Dec. 20, 1976 [NZ] New Zealand ..... 182924

[51] Int. Cl.[3] ..... A61G 11/00

[52] U.S. Cl. ..... 128/1 B; 128/205.26

[58] Field of Search ..... 128/1 B, 205.26

[56] References Cited

U.S. PATENT DOCUMENTS

| | | | |
|---|---|---|---|
| 1,947,007 | 2/1934 | Hoffman | 128/1 B |
| 2,292,120 | 8/1942 | Hanby | 128/1 B |
| 2,600,240 | 6/1952 | Grieb | 128/1 B |
| 2,633,842 | 4/1953 | Higgs | 128/1 B |
| 2,648,327 | 8/1953 | Gibbon | 128/1 B |
| 3,076,451 | 2/1963 | Stoner | 128/1 B |
| 3,335,713 | 8/1967 | Grosholz et al. | 128/1 B |
| 3,464,388 | 9/1969 | Stout | 128/1 B |
| 3,529,590 | 9/1970 | Grosholz | 128/1 B |
| 4,034,740 | 7/1977 | Atherton et al. | 128/1 B |

FOREIGN PATENT DOCUMENTS

| | | | |
|---|---|---|---|
| 1094444 | 5/1955 | France | 128/1 B |

*Primary Examiner*—Henry J. Recla
*Attorney, Agent, or Firm*—Holman & Stern

[57] ABSTRACT

A multi-modal incubator of a non-circulatory type which isolates a controlled leakage incubator space from any fan to minimize noise within the space. The incubator has a bacterial filter and humidifier that can be readily maintained without it being necessary to disturb the enclosed space. For the purpose of isolating the fan the filter is always positioned in the ducting from the fan to the incubator space.

15 Claims, 17 Drawing Figures

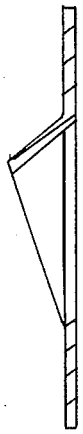
FIG. 7.
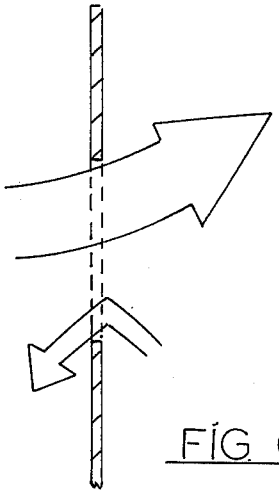
FIG. 6.
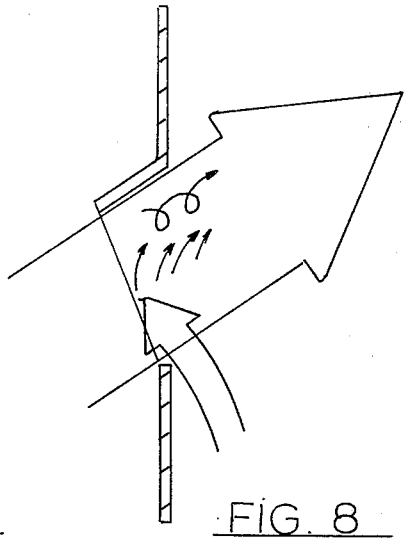
FIG. 8
FIG. 9
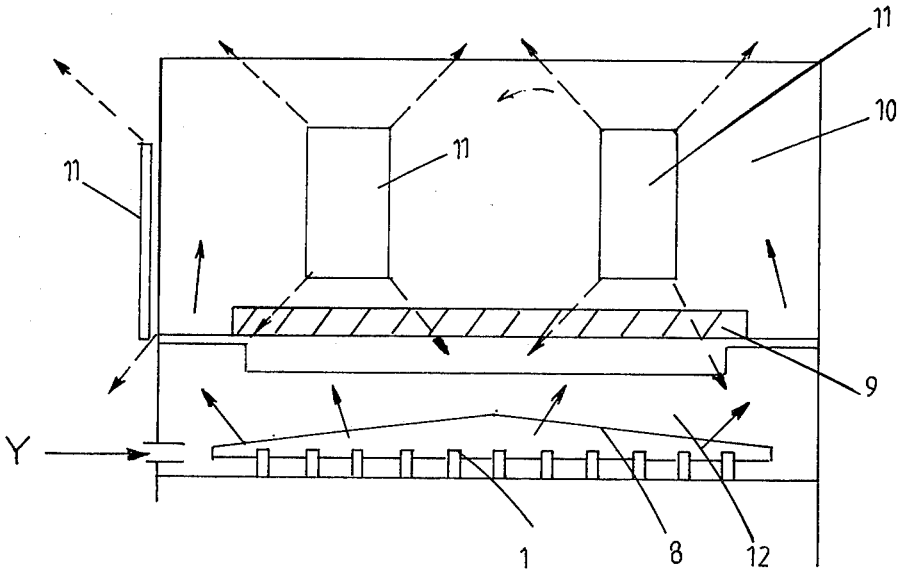

MULTI-MODAL LOW NOISE INCUBATOR

CROSS REFERENCE TO RELATED APPLICATIONS

This application is a continuation in part of my application U.S. Ser. No. 857,913 filed Dec. 6, 1977 now abandoned and is based on my New Zealand Patent Application No. 182,924 filed on Dec. 20, 1976.

The subject matter of the present application is contained in a divisional of that New Zealand patent application. The subject matter now contained in New Zealand patent application No. 182,924 relates to a novel opening for an incubator which is adapted to allow the same to be opened and for air or other life support fluids to pass from the controlled environment without cold air rolling in over the bottom lip of the opening. Such an opening forms the basis of my U.S. Pat. No. 4,191,174.

BACKGROUND OF THE INVENTION

1. Field of the Invention

The present invention relates to improvements in or relating to incubators, and in particular, although not solely to a low noise incubator space multi-modal incubator for human babies which is capable of easy maintenance yet provides efficient incubation.

2. Description of the Prior Art

Modern incubators at hospitals are complex machines which are adapted to maintain the premature or sickly baby in a controlled environment. It is standard nowadays for not only the temperature to be controlled but also the humidity and oxygen content of the air which is passed through the chamber in which the baby rests.

Many conventional or existing incubators include water tanks which are used to provide humidification of the incubator atmosphere. Such water is ideally situated underneath the bed portion and air is blown as required thereover to be both heated and humidified as required. However, the big difficulty with incubators of this type is the fact that sterilization of the unit is a time consuming and often incomplete task, owing to the fact that much of the area which must be sterilized is often at a difficult place to reach, especially filling and draining devices. Another major disadvantage is the fan noise in the enclosed environment which can damage a baby's hearing permanently.

U.S. Pat. No. 3,076,451 dated Feb. 5, 1963 of George H. Stoner Assignor to Air Shields Inc. discloses an infant incubator of an air circulatory type which has a fan located below the bedding surface so as to force air to pass through a plurality of chambers and through a humidity control device before it passes into the occupant space. Primarily the invention of that patent was the arrangement of a cooling chamber and a humidifying chamber in parallel on the air flow circuit so as to maximise the humidification effect owing to the fact that a proportion of the air flow which is not cooled undertakes the actual entrainment of moisture step. Such an incubator however was designed without the question of noise levels in mind and no disclosure is made or even contemplated which would result in the effect of the fan noise being isolated from an occupant of the incubator space. In fact, with the fan positioned in a plenum chamber as would appear to be the case the noise would tend to be excessive and and hence the incubator of U.S. Pat. No. 3,076,451 would be both both noisy and impossible to clean while the space is being occupied.

U.S. Pat. No. 3,464,388 dated Sept. 2, 1969 in the name of R. W. Stout discloses a Gnotobiotic System which includes a controlling unit which monitors the environment of a plurality of slave environments. While one of the units of the overall system shows the use of a blower or fan which is detachable and which is mounted externally of the means defining the incubator space such a system was devised without noise levels in mind and in this regard no consideration has clearly been given to the question of isolating the effect of any fan noise from the environment. While such a blower as is used in the system includes an intake filer there is clearly no disclosure of a humidifier being interposed between the blower together with a bacterial filter in order to minimise noise.

U.S. Pat. No. 3,335,713 dated Aug. 15, 1969 to J. R. Grosholz et al assignors to Air Shields Inc. discloses a circulation system of or for an incubator which can be oxygen enriched and which ensures the oxygen when used is subject to a filtering action. The filter utilized not only filters the make-up air but also filters any oxygen that may be used. The make-up air is introduced into the system through the filter and from thence by pipe lines through a blower into the incubator space itself. Again no question of sound isolation is apparent. Persons skilled in the art when viewing for example, FIG. 3 of U.S. Pat. No. 3,335,713 will envisage the possible harmful sound levels that would be generated thereby.

There is therefore some desire to provide a low sound level incubator which preferably also has additional efficiencies built thereinto to ensure that the incubator can be used to its best advantage.

It is therefore an object of the present invention to provide a method and/or means which will go at least some way to meet some of the abovementioned desiderata or which will at least provide the public with a useful choice.

BRIEF SUMMARY OF THE INVENTION

Accordingly in one aspect the present invention consists in a multi-modal incubator having low noise characteristics within the incubator space for a creature including a human baby, said incubator comprising means defining a bedding support, means defining a plenum chamber beneath the bedding support means which is in communication with space above said bedding support means, substantially fully transparent means which encloses space above and substantially around said bedding support means to define the incubator space, the space enclosing means having a plurality of access-ways to the incubator space and said bedding support means, which access-ways have closures therefor at least some of which are of a non-sealing nature so as to enable a fluid loss from the incubator space if the incubator space is maintained above ambient air pressure, electrical resistance heating means disposed so as to heat fluid in or entering said plenum chamber, means externally of said plenum chamber and said incubator space to apply a flow of a life supporting fluid from externally of said plenum chamber and said incubator space, a humidifier mounted externally of said plenum chamber and said incubator space, a bacterial filter, conduit means selectively operable at least in a mode selected from the group consisting of (i) so that life supporting fluid is passed by the life supporting fluid flow means to the bacterial filter and from thence to the plenum chamber and (ii) so that life supporting fluid is passed by the life supporting fluid flow means to the bacterial filter, then to the humidifier and from thence to the plenum chamber and monitoring means capable of controlling the environment of life supporting fluid within said incubator space by controlling at least the operation of said electrical resistance heating means.

In a further aspect the invention consists in a multimodal incubator for a human baby having low noise characteristics within the incubator space, said incubator comprising a chassis, means defining a bedding support for a baby supported from said chassis, means supported from said chassis defining a plenum chamber beneath the bedding support means, which plenum chamber is in communication with space above said bedding support means, substantially fully transparent means supported from said chassis which encloses space above and substantially around said bedding support means to define the incubator space in which a human baby can rest on said bedding support, the space enclosing means having a plurality of access-ways to the incubator space and said bedding support means, which access-ways have closures therefor at least some of which are of a non-sealing nature so as to enable a fluid loss from the incubator space if the incubator space is maintained above ambient air pressure, electrical resistance heating means disposed so as to heat fluid in or entering said plenum chamber, a fan mounted externally of the means defining said bedding support, plenum chamber and space enclosing means capable of intaking air from the surroundings and if appropriately connected to said plenum chamber of maintaining said incubator space slightly above ambient pressure, a humidifier mounted to said chassis externally of said plenum chamber and said incubator space, a bacterial filter supported from said chassis, conduit means selectively operable at least in a mode selected from the group consisting of (i) so that life supporting fluid is passed by the fan to the bacterial filter and from thence to the plenum chamber and (ii) so that air is passed by the fan to the bacterial filter then to the humidifier and from thence to the plenum chamber, and monitoring means capable of controlling the air environment within said incubator space by controlling at least the operation of said electrical resistance heating means by monitoring at least one parameter selected from the group consisting of (i) skin and/or rectal temperature of a human baby within said incubator space and on said bedding support, and (ii) the air temperature within said incubator space.

Preferably said life supporting fluid flow means is selected from the group consisting of (i) a fan capable of intaking ambient air (ii) a source of oxygen under pressure (iii) a fan with an intake of air which is adapted by appropriate ducts and a source of oxygen under pressure to provide a flow of oxygen enriched air, and (iv) ducting means from a static means which reticulates life supporting fluid under pressure about a building.

Preferably said life supporting fluid flow means is capable of providing in use an incubator space fluid pressure slightly above the ambient pressure.

Preferably a head box is provided within said incubator space and said conduit means is selectively operable in a mode selected from the group consisting of (i) so that life supporting fluid is passed by the life supporting fluid flow means to the bacterial filter and from thence to the head box (ii) so that life supporting fluid is passed by the life supporting fluid flow means to the bacterial filter thence to the humidifier and thence to the head box, (iii) so that pure oxygen is passed to the bacterial filter and from thence to the head box and (iv) so that oxygen enriched air is passed to the bacterial filter and from thence to the headbox.

Preferably said monitoring means controls at least the operation of said electrical resistance heating means on a feed back of a parameter selected from the group consisting of (i) the temperature of life supporting fluid within said incubator space, and (ii) the skin and/or rectal temperature of a creature within the environment.

Preferably said chassis of the incubator includes the transformer and a battery capable of being maintained substantially in a fully charged condition by the transformer during normal use of the incubator, said battery being capable in the absence of an external source of electrical power to said transformer of being capable of operation for a period said monitoring means and a power failure alarm.

Ideally said humidifier controls the humidity of air or other gas passing therethrough.

BRIEF DESCRIPTION OF SEVERAL VIEWS OF THE DRAWINGS

One preferred form of the present invention will now be described with reference to the accompanyng drawings in which:

FIG. 7 shows in section the opening which forms the basis of my U.S. patent application U.S. Ser. No. 860,085 filed Dec. 13, 1977.

FIG. 8 shows the more favourable air flow suitable for an incubator which results from the employment of an opening of the kind shown in FIG. 7 as opposed to an opening of the kind as shown in FIG. 6, FIG. 9 is a frontal diagrammatic view of an incubator in accordance with the present invention showing an air flow denoted by reference Y into the plenum chamber and around and over electrical elements and from thence through a baffle plate upwards and around the bedding support means and into the incubator space itself from which it issues in the manner shown substantially by dotted arrows even when the closures as shown cover the ports, there being of course some small degree of natural gravitly convection within the incubator space.

DETAILED DESCRIPTION

Figure 5:
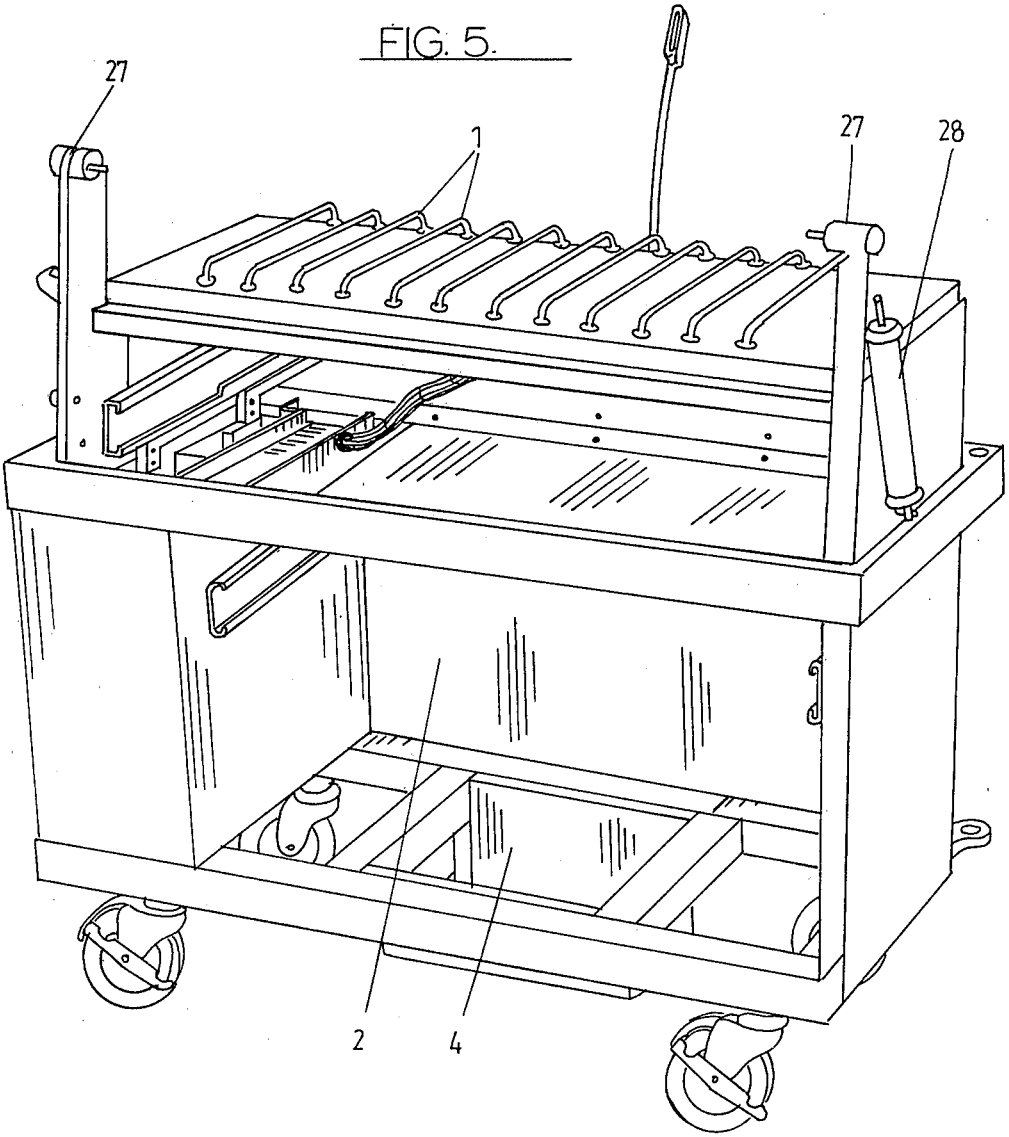
FIG. 5 is a view from the same direction as FIG. 1 but showing the space enclosing means fully removed from the pivotal mounts thereof and showing the modular monitoring console together with its circuitry removed to show more or less the nature of the chassis of the unit, the lower open region of the chassis being that region which when in the condition as shown in FIG. 1 would include the transformer and battery or batteries as will be hereinafter described together with any oxygen bottles and the like, FIG. 6 shows the air flow movement a from slightly over pressure environment through and out of a conventional opening.

In the preferred form of the present invention a mobile chassis is provided which will allow the incubator to be moved from place to place. The nature of the chassis can best be determined by reference to FIG. 5 where the wheeled nature of the chassis can be seen. Shown particularly in FIG. 5 is the arrangement whereby a plurality of electrical elements 1 are arranged on a framing member which will form the lower most extent of the plenum chamber. Also shown in FIG. 5 is a cavity 2 into which will be slide fittable a drawer arrangement denoted in FIG. 1 by reference number 3. The compartment 2 would include provision at 4 for a transformer which would receive alternating current and would pass the transformed current at isolating voltage to the incubator power system and be used to provide an electrical circuit within the chassis for the powering of for example the electrical elements 1, the humidifier 5 and of course the fan 6. In the event of an AC power failure the incubator will continue to operate with all of its alarm functions for at least a substantial period during which if desired a standby source of AC current could be provided.

The incubator of the present invention includes many engineered facilities to allow access to the incubator when it contains a baby and to allow even more access to the incubator when it is being resterilised between uses. For example to strip the incubator down to the condition as shown in FIG. 5 requires a minimum of time, as also does the stripping of the left hand end of the incubator (with reference to FIG. 5) as shown for example, by reference to FIG. 3.

In the preferred form of the present invention a slide out modular console 7 is provided which includes digital displays of the various parameters and desired environmental conditions being sought for either the skin of a baby located in the incubator or having regard to the air or oxygen environment of the incubator space. In this regard ideally the modular unit which in the preferred form of the present invention will be a fully plug in type unit has the facility to monitor temperature to plus or minus 0.1° C. Ideally the solid state unit is a proportional thermostat circuit with patient servo control. As desired, actual nursing temperatures (air/skin) plus rectal monitoring would be displayed on a single digital readout. High temperature alarm and heater safety cut off point would be preset. Persons skilled in the art will appreciate the type of circuitry and sensors involved.

Figure 10:
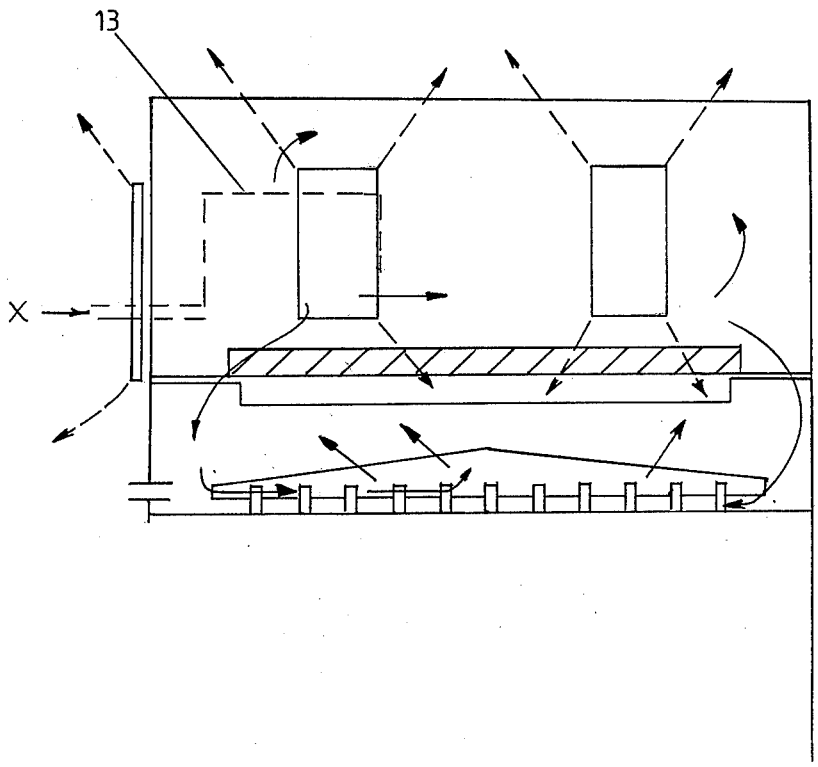
FIG. 10 shows a similar view to that of FIG. 9 but showing where the air flow is directed when the air flow is directed in a stream X into a head box disposed above the bedding support means and within the incubator space, the flow in this case showing a greater degree of convection and gravity circulation and interchange between the plenum chamber and the incubator space.
Figure 11:
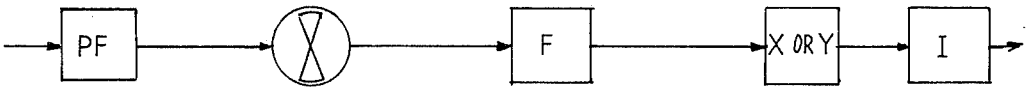
FIG. 11 shows one mode of operation of the incubator in accordance with the present invention where ambient air is passed through a primary filter denoted by PF to a fan denoted by the symbolic representation of a fan to the bacterial filter and from thence by means of a stream X or Y (having regard to X and Y as shown in FIGS. 10 and 9 respectively) into the incubator space and from thence back out through the ports whether closed or open to the surroundings.
Figure 12:
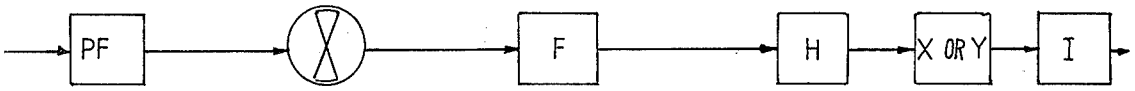
FIG. 12 is an alternative form to that of FIG. 11 showing the position the humidifier takes i.e. between the bacterial filter and the incubator when the same is linked in by the conduit means.
Figure 13:
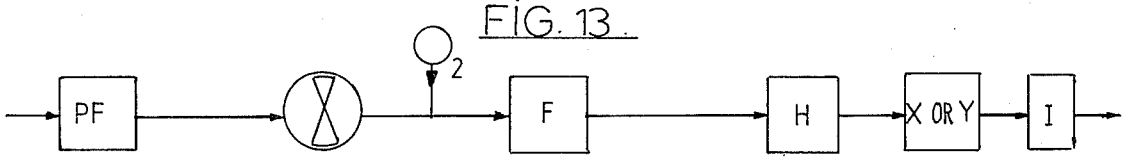
FIG. 13 is an alternative to the arrangement shown in FIG. 12 showing how oxygen can be fed for example into the flow from the fan to the bacterial filter.
Figure 14:
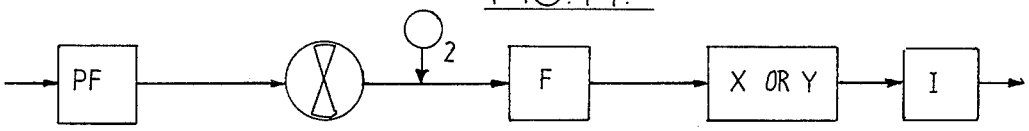
FIG. 14 shows how oxygen can be fed for example into the flow from the fan to the bacterial filter in an arrangement substantially as shown in FIG. 11.
Figure 15:
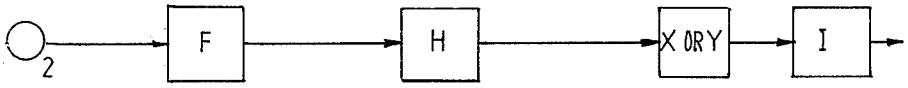
FIG. 15 shows a system where the fan can be totally disconnected if desired and air, air plus oxygen or just oxygen can be taken via the filter and the humidifier into the incubator itself, preferably passing through the head box X although it could be passed if desired into the plenum chamber.
Figure 16:
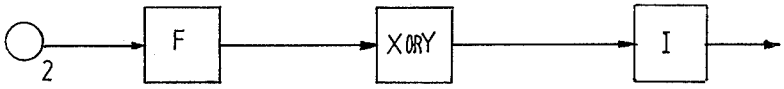
FIG. 16 shows the arrangement of FIG. 15 but without the humidifier.

In the preferred form of the present invention the apparatus is to be one that can be varied in its mode of operation. In this regard reference should be made firstly to FIGS. 9 and 10, where the various flow arrangements are shown. In the case of FIG. 9 where an inlet of conditioned air or other life supporting fluid passes in the stream Y into the plenum chamber it can be seen that the stream passes over the elements 1 and as the stream is being heated it moves upwards and passes through a baffle plate 8 and thus skirts about the bed supporting surface 9 into the incubator space 10 proper and from thence issues eventually through the normally closed ports 11. Of course, some proportion of the air passed in by the stream Y may gravitate down during the course of a convection circulation throughout the plenum chamber 12 and the incubator space 10. However ideally the streaming of the flow is such that such a circulation is kept to a minimum. Referring to FIG. 10 in this form of flow where a stream of conditioned life supporting fluid is passed in stream X into a head box 13 (shown in dotted outline only) the circulation is much the same although there is a tendency for the unheated air to gravitate down to the elements to be thus heated and hence move upwards and issue outwards substantially as shown. The form of circulation as shown in FIG. 10 is that which would be utilised where for example an oxygen rich environment, perhaps pure oxygen, is necessary in order to maintain the life of an ailing infant.

Referring to FIGS. 11 to 16 there can be seen the various types of flow arrangement that can be used with the preferred apparatus of the present invention. In each case except in the case where oxygen is passed under its own containment pressure into the incubator space preferably a preliminary filter PF is used prior to the air being passed by the fan to the bacterial filter F. Ideally an autoclavable bacterial filter is used. Also shown and as previously described there are a variety of flow options open to an operator before the flow is passed either in a stream X or Y into the incubator I. Similarly with pure oxygen.

Referring specifically to the apparatus as shown it can be seen that at an end of the incubator there is provided the fan 6 (see the reverse side of the fan 6 in FIG. 3) which draws in ambient air and passes the same via a flexible conduit 14 to air and/or oxygen flow sensing housing or the like 15. An oxygen line 16 leading from oxygen inlet 26 can if desired pass oxygen into the duct 14 from the fan 6 for enrichment purposes. Obviously if the fan is turned off the alarm will operate.

Figure 3:
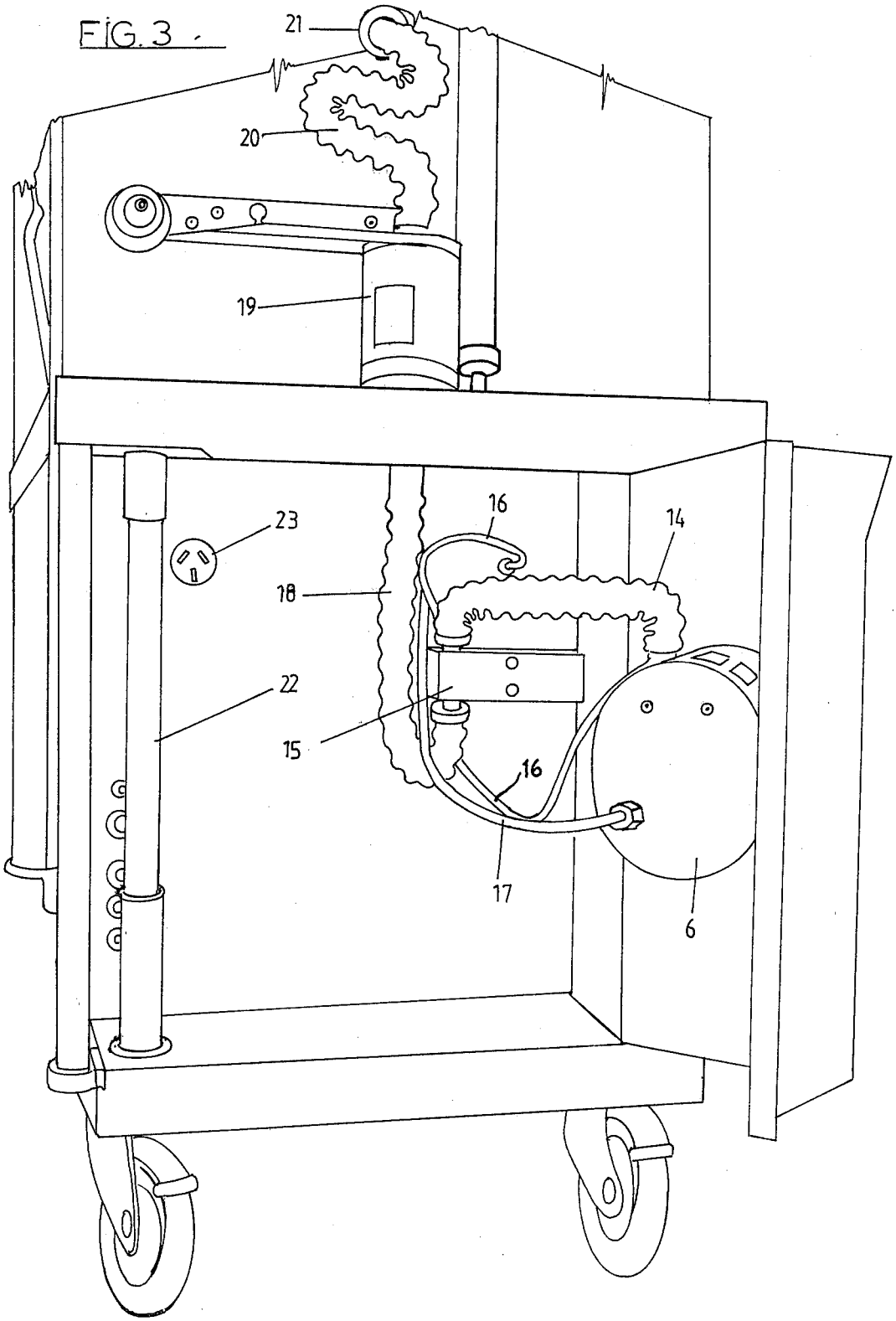
FIG. 3 is a view from substantially the same direction as FIG. 2 but showing the rear side of the fan into the air duct of which if desired oxygen can be fed to an oxygen/air flow sensing housing and showing a conduit from that housing being passed to the bacterial filter and from thence into the port of the plenum chamber which as can be seen from FIG. 2 is more or less directly below the port to the head box.

From the air/oxygen flow housing 15 as shown in FIG. 3 a flexible conduit ducts the life supporting fluid to the bacterial filter 19 or F. The conduit 18 for this purpose is removable but owing to its isolation from incubator space ideally the same need not be frequently removed throughout use with the same infant. The bacterial filter 19 is preferably an autoclavable filter substantially of the shape shown. From the filter 19 a further duct 20 of the conduit means passes fluid in through a port 21 into the plenum chamber 12 so as to make contact with the electrical elements 1.

Figure 2:
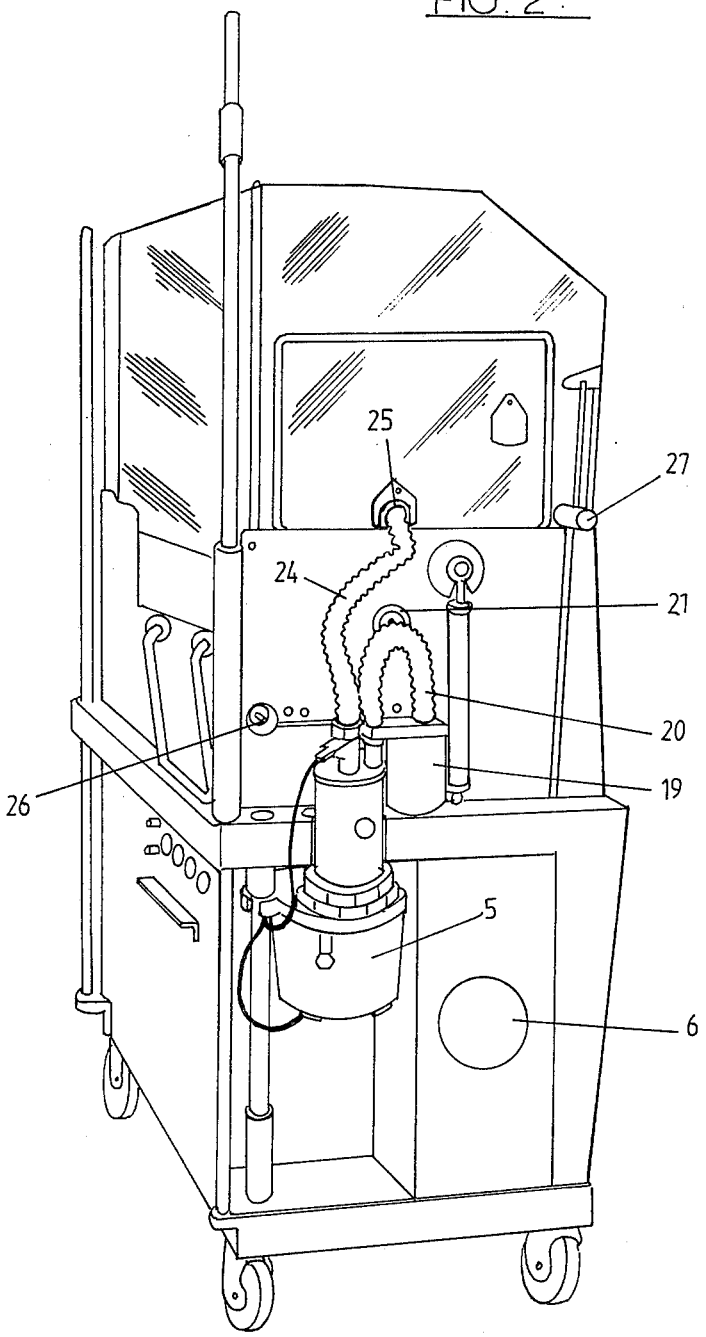
FIG. 2 is a view of the incubator of FIG. 1 taken from the left hand end direction when considering the view of FIG. 1 and showing the conduit means connected chassis carried ambient air intaking fan ducting air through the bacterial filter and from thence to the humidifier which is shown in its operative condition and from thence into a head box above the bedding support and within the incubator space.
Figure 4:
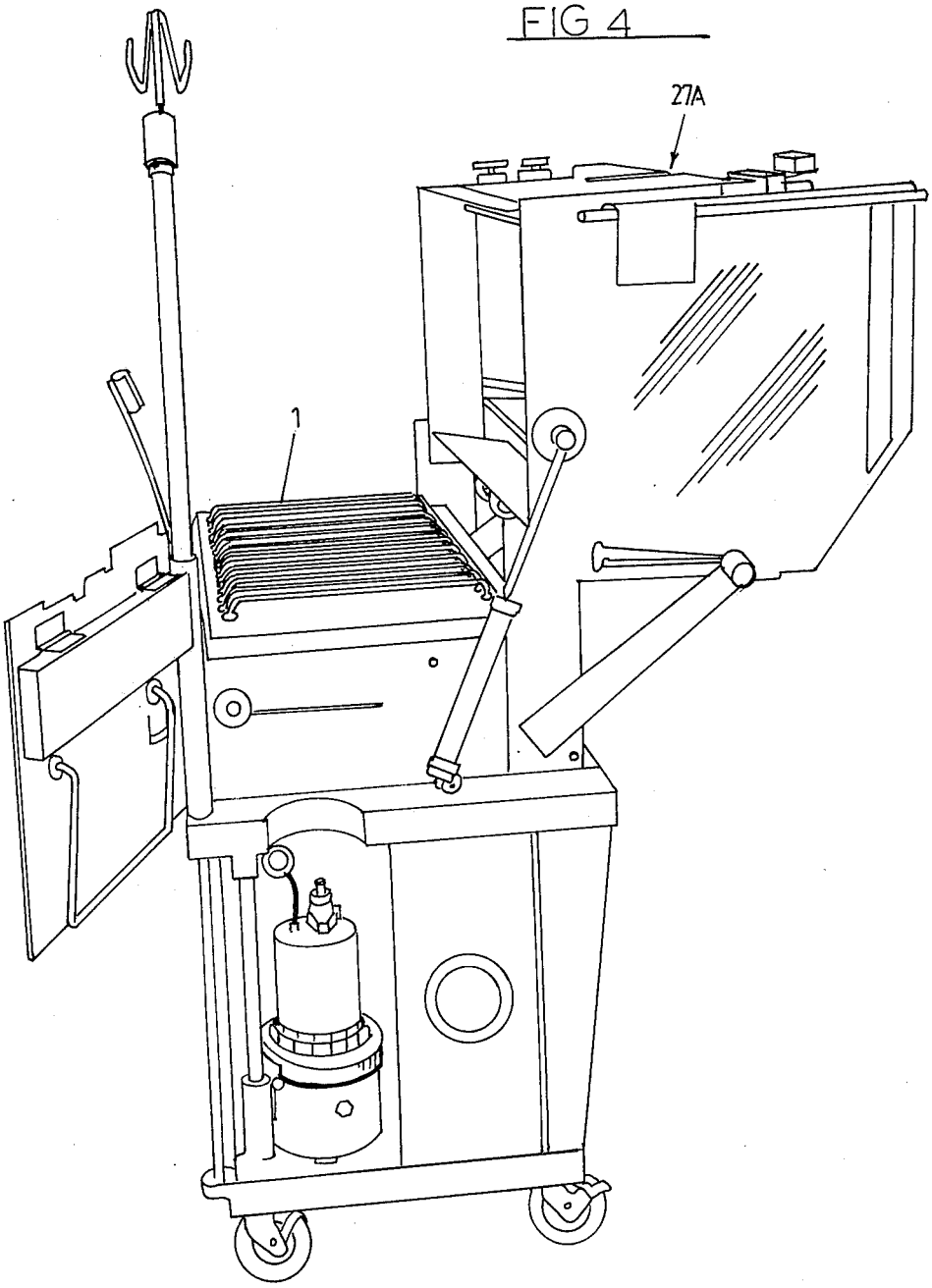
FIG. 4 shows from substantially the same direction as FIGS. 2 and 3 the incubator unit with the substantially fully transparent space enclosing means tilted over to allow access to the plenum chamber, the electrical elements of the electrical heating means being revealed through the appropriate baffle plate and bedding support means being cleared therefrom, the figure also showing the humidifier in its lowered storage condition.

Disposed and slidably supported from a pole or the like means 22 is the humidifier 5 which is preferably an electrically operated humidifier manufactured by Fisher & Paykel of New Zealand as their "328" humidification unit as disclosed in DESIGNSCAPE No. 85 October 1976 published by the New Zealand Industrial Design Counsel at page 24 and as described and claimed in New Zealand Patent specification No. 183517. It would control the humidity of air/oxygen flowing therethrough. As can be seen from the drawings the same is moveable between a condition as shown in FIG. 2 where it is in use to a condition as shown in FIG. 4 where the same is still dependent from the member 22 but which is tucked away neatly for storage. Obviously however means is provided so that the same can be removed completely for maintenance, replacement, sterilisation etc, as for example shown in FIG. 3. Also shown in FIG. 3 is a 3-point plug 23 which is used to power the humidifier 5.

Turning to FIG. 2 it can be seen that a conduit 24 leading from the exit port of the humidifier 5 leads a stream of humidified air or life supporting fluid via the port 25 into the head box 13 which is shown in dotted outline on FIG. 10. This movement through the conduit 25 which itself forms part of the conduit means is the flow X shown in FIG. 9 and showed symbolically in the flow diagrams of FIGS. 11 to 16. In FIG. 2 therefore it can be seen that when the incubator is being brought in to line as in flow diagrams of FIGS. 12, 13 and 15 the conduit 20 from the bacterial filter is connected to the ingress port of the humidifier 5.

In the preferred form of the present invention a primary filter PF is provided externally of the fan for example fitted on the opening shown in FIG. 2 for the fan 6. Such a primary filter should be washable.

Other features that are discernable from a perusal of FIG. 2 is the connection to allow oxygen to be piped directly into the air duct leading from the fan and filter and thence to the environment in which a baby is contained. This port is denoted by reference numeral 26.

The actual substantially fully transparent space enclosing means comprise a perspex or the like surround 27A which is pivotted by means 27 and which includes a plurality of pneumatic or the like damper units 28 so as to allow the same in a controlled fashion to be swung over as shown in FIG. 4 for a complete sterilisation without it being necessary to remove the same from its pivot points. Obviously however removal from the pivot points as shown in FIG. 5 can be achieved. The member 27A however includes a plurality of openings 11 some of which are at the end to allow access to the baby within the chamber or to allow the baby support to be slide therefrom. Obviously side openings are required for normal use and it is desired that all ports have inwardly directed flanges of the kinds shown in FIGS. 7 and 8 so that the substantially rigid flanges project inwardly more at the top than they do at the sides. Preferably the flanges are non-existent at the bottom of such openings. Preferably slidable and non-sealing closures are provided therefor and as more fully disclosed in my U.S. Pat. No. 4,191,174 as previously mentioned. The detrimental air flow as shown in FIG. 6 where even with an over pressure environment within the incubator space a rolling over of cold unfiltered air occurs does not occur owing to the exterior air that would otherwise slip over the bottom of the opening being entrained in the gas emerging therefrom. Such flows have been determined by smoke tests.

Figure 1:
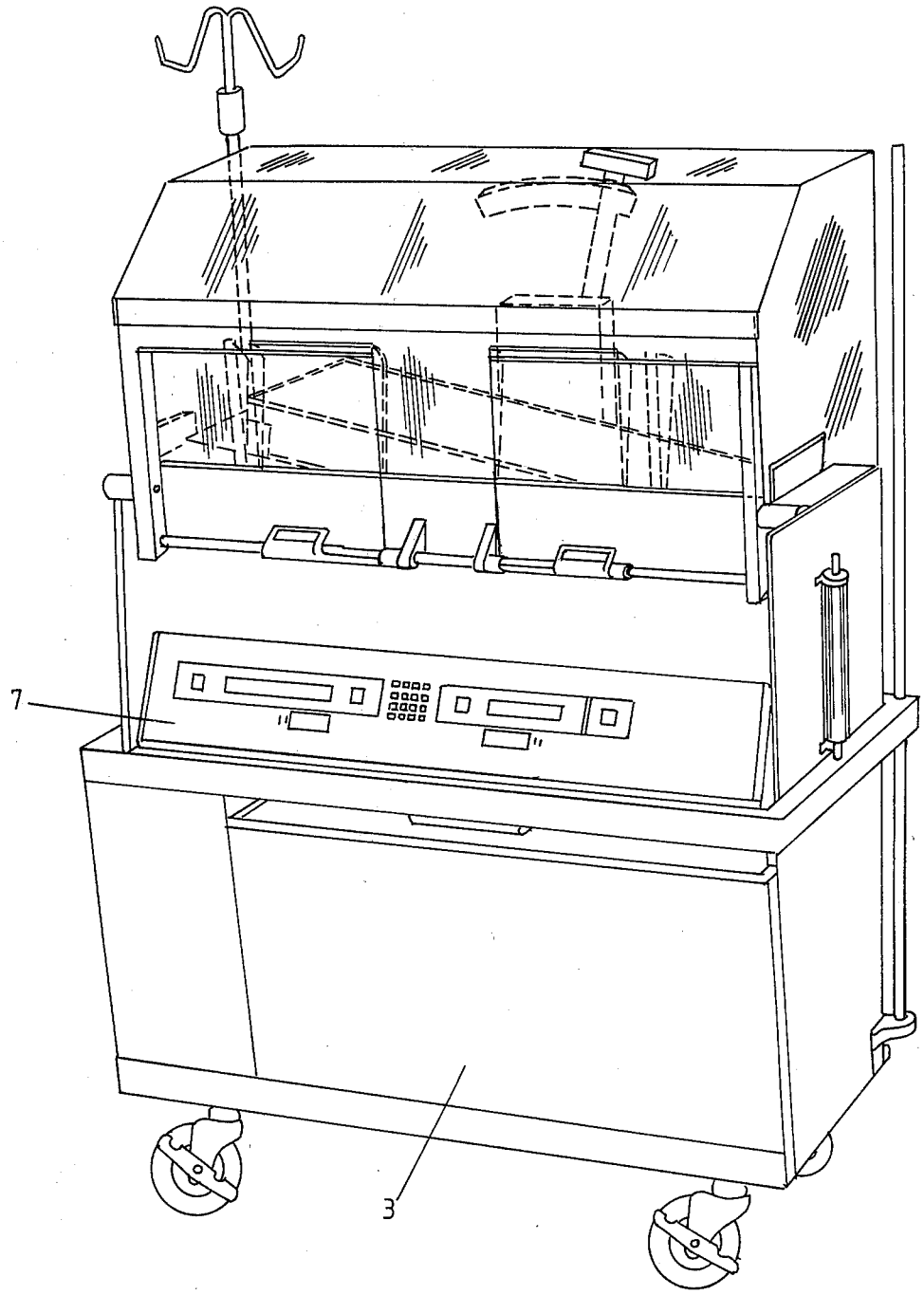
FIG. 1 is a frontal view of a human baby incubator in accordance with the present invention showing the control console of the monitoring means and showing in dotted outline in a tilted condition the bedding support.

A great deal of explanation could be given of the various facets and ancillary features of the incubator as shown in the accompanying drawings, for example, the provision of a tray or a tray opening to allow X-ray film or plates to be positioned directly underneath the bedding support. Similarly some considerable time could be spent in describing the tilting arrangement as shown in dotted outline in FIG. 1 of the drawings. Similarly detail could be given concerning the upstanding member as shown in FIG. 1 at the top left hand end thereof suitable for carrying tubes etc from for example, saline drips etc. However, all of these features will be perfectly clear to a person skilled in the art having regard to the flow diagrams and the descriptions in regard thereto and the plurality of drawings which show the various constructional features all in different conditions.

Figure 17:
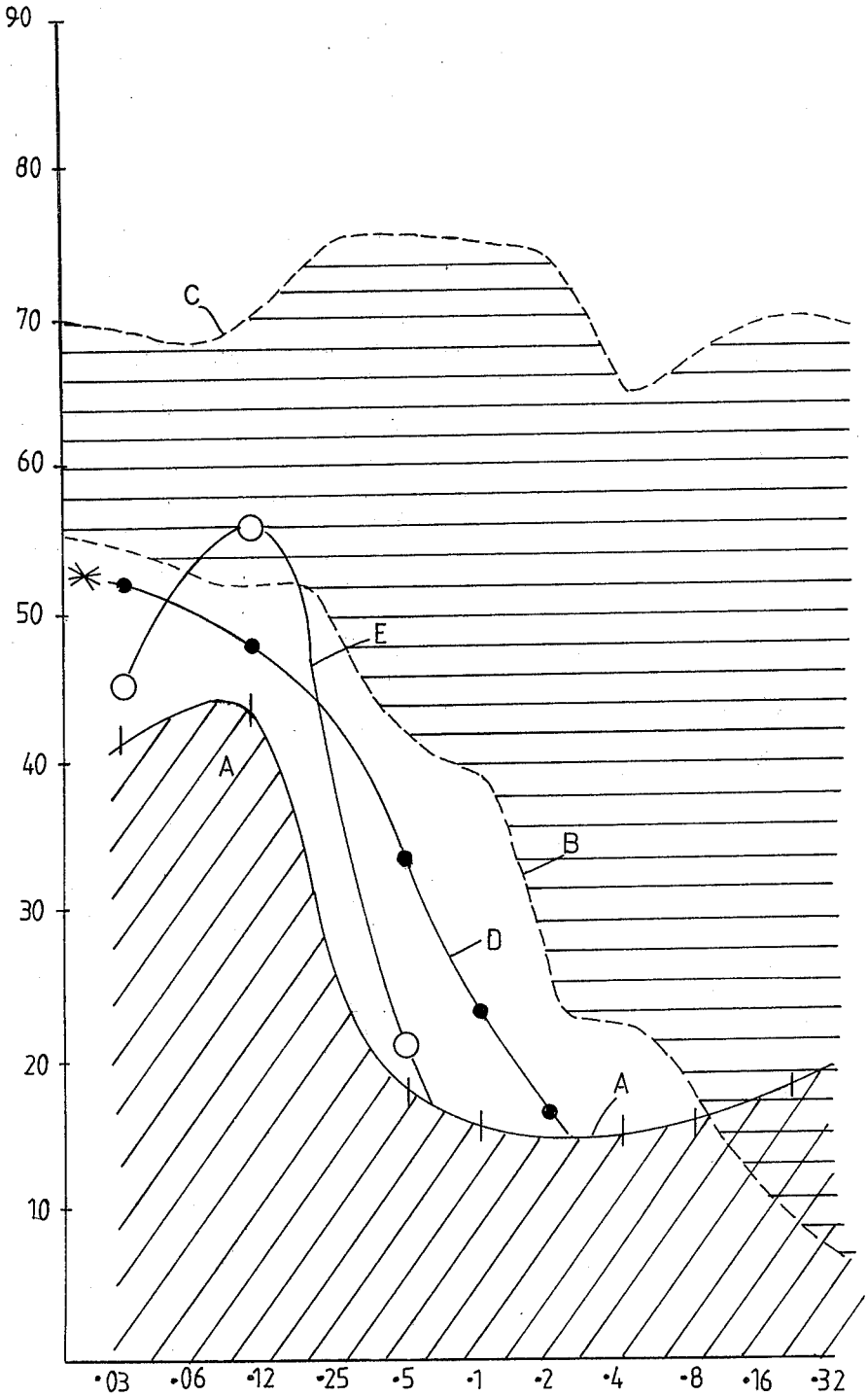
FIG. 17 shows a graph of noise level results for an incubator in accordance with the present invention against noise levels in the range of 6 pre-existant incubator models, the graph showing decibels against kilohertz.

A person skilled in the art therefore will appreciate that with all of the preferred flows at least the bacterial filter F or 19 is interposed between the fan 6 and the incubator space. In most usual modes of operation where the humidifier is also used the fan is even more isolated from the incubator space. Add to this of course the fact that the ingress of air to the incubator space is via a plenum chamber thus further reducing the noise pollution within the incubator space. FIG. 17 shows a graph of decibels against kilohertz with the cross-hatched region bounded by line A showing background noise generally in an incubator space in accordance with the present invention. Lines B and C with the region in between is a range within which six conventional incubators fall. Line D shows the noise level on or around the bed support of an incubator in accordance with the present invention and line E shows the sound inside a head box in an incubator in accordance with the present invention when there is a full volume gas flow through the Fisher & Paykel "328" humidifier. It can be seen therefor that the fan isolation over a wide range of frequencies reduces the noise that can be damaging to an infants hearing i.e. to within 10 decibels of background noise over a wide frequency range.

In a preferred form of the present invention the fan 6 will be used where there is an absence of a reticulated air stream. Obviously if a reticulated air stream is used then noise levels will be reduced even further as the fan of such a reticulated air stream will be many many yards remote. In any event, where however, an air stream is being used, a constant air stream is preferably issued into the plenum chamber as stream Y or into a head box as stream X. Ideally at normal operating conditions a flow of approximately 10 liters per minute is provided irrespective of whether or not there is oxygen enrichment. This will provide the required controlled leakage of air from the incubator space without there being any risk of a carbon dioxide build up even in the event of a fan failure and without there being a significant wastage of the heating and humidifying effort.

From the foregoing then it can be seen that with a substantially constant air flow the parameter that is controlled by the monitoring means is ideally just the air temperature. Humidity is controlled by the humidifier itself. Persons skilled in the art will appreciate how feedback can be derived either from the baby's skin or from the air itself. Also a person skilled in the art will appreciate how by doing away with the conventional bath type humidifier which is disposed underneath the bed support surface, the present invention provides a unit which is far more readily acceptable from a cleanliness and maintenance point of view. Other features of course will be readily apparent.

On the basis of the foregoing then it is believed that the present invention should find widespread acceptance as a well engineered incubator having desirable cleanliness and sound level properties.

What is claimed is:

1. A multi-modal incubator for animals including human beings comprising:

a chassis having upstanding sides, a bedding support mounted on the top of said chassis, an incubator containing mounted on the top of said chassis, comprising a transparent cover having sides and a top which defines an enclosure supplied with a life-support fluid above and substantially around the bedding support, means defining at least one access opening in a side of said cover for allowing at least a person's arm to be extended through said side into said enclosure, said access opening having top, bottom, and side portions, rigid means movably disposed to the outside of said cover means to allow for opening and substantial closing of said access opening, means for providing said enclosure with an environment having a gas pressure above that externally of said enclosure, said means defining said at least one access opening including self-supporting canopy-like flange means projecting inwardly and downwardly of said enclosure at the top portion of said access opening and extending at least along upper parts of said side portions of said access opening, said flange means extending further into said enclosure at upper regions of said flange means than at lower regions of said flange means whereby, opening said access opening will not allow any substantial rolling over by air from outside the access opening into said enclosure to hence affect the incubator environment, a plenum chamber mounted on said chassis beneath said enclosure and bedding support, which chamber is in communication with the interior of said enclosure sufficient to permit limited recirculation fluid flow between said plenum chamber and the interior of said enclosure, an electrical resistance heating means disposed in said plenum chamber so as to permit heating the lift-support fluid passing therethrough, a life-support fluid supply source of ambient air, oxygen, or a mixture thereof located external to both the incubator cover and the plenum chamber, a removable conduit means, connecting said fluid supply source to said plenum chamber, a fan mounted on said chassis external to said plenum chamber and incubator cover and operably connected to said life support fluid supply source and to said conduit means to supply said life support fluid under pressure to said plenum chamber, a removable bacterial filter mounted on said chassis and located between said fan and said plenum chamber, and a monitor mounted on said chassis operably associated with said incubator so as to be capable of controlling the environment within said enclosure by controlling at least said electrical resistance heating means.

2. The incubator of claim 1 wherein:

the life-support fluid is oxygen.

3. The incubator of claim 1 wherein:

the life-support fluid is oxygen, the incubator contains a head-box, and said fluid is introduced through the incubator container directly to said head-box.

4. The incubator of claim 1 wherein:

the life-support fluid is ambient air, and a preliminary filter is provided between the source of the ambient air and said fan.

5. The incubator of claim 4 wherein:

the incubator contains a head-box, and said life-support fluid is introduced through the incubator container directly to said head-box.

6. The incubator of claim 5 wherein means to add oxygen to the ambient air is provided mounted on said chassis at a point between the fan and the bacterial filter.

7. The incubator of either claim 1, 2, 3, 5, or 6, and further comprising a removable humidifier mounted on said chassis external of the incubator cover and plenum chamber and operably connected to said conduit means to humidify said life support fluid between said bacterial filter and said plenum chamber.

8. The incubator of claim 1 wherein said monitor controls the environment by measuring the temperature of the life-supporting fluid within the incubator space and activating the heating means when said temperature falls below a set low point and deactivating the heating means when said temperature rises above a set high point.

9. The incubator of claim 1 wherein said monitor controls the environment by measuring the skin or rectal temperature of a creature within the incubator space and activating the heating means when said temperature falls below a set low point and deactivating the heating means when said temperature rises above a set high point.

10. The incubator of claim 1 wherein a power isolating transformer and a battery are mounted on the chassis, said battery being capable of being maintained substantially in a fully charged condition by the transformer during normal use of the apparatus, and said battery being capable of operating the apparatus during a power failure.

11. The incubator as defined in claim 1 wherein said flange means terminates adjacent said bottom portion of said access opening.

12. The incubator as defined in claim 1 wherein said flange means extends into said enclosure a maximum distance at a top region thereof and progressively decreases in the amount of inward projection from said top region to a bottom region thereof, said flange means terminating adjacent said bottom portion of said access opening.

13. The incubator as defined in claim 1 wherein said access opening is substantially rectangular in shape.

14. The incubator as defined in claim 1 wherein said rigid means is a sliding door.

15. The incubator as defined in claim 14 wherein said sliding door when in the substantial closing condition provides a non-airtight closure of said access opening.

* * * * *